US007519318B2

(12) United States Patent
Kurogawa et al.

(10) Patent No.: US 7,519,318 B2
(45) Date of Patent: Apr. 14, 2009

(54) ELECTROPHOTOLITHOGRAPHIC IMAGE FORMING DEVICE AND IMAGE DEVELOPING METHOD

(75) Inventors: Naonori Kurogawa, Suwon-si (KR); Masahiko Itaya, Suwon-si (KR); Kyu-Cheol Shin, Seoul (KR); Tsutomu Teraoka, Seongnam-si (KR); Tsutomu Sasaki, Suwon-si (KR); Myung-Kook Ahn, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 85 days.

(21) Appl. No.: 11/297,354

(22) Filed: Dec. 9, 2005

(65) Prior Publication Data

US 2006/0222416 A1 Oct. 5, 2006

(30) Foreign Application Priority Data

Apr. 4, 2005 (KR) ..... 10-2005-0028073

(51) Int. Cl.
*G03G 15/09* (2006.01)

(52) U.S. Cl. ..... 399/269; 399/53; 430/122.1

(58) Field of Classification Search ..... 399/269, 399/267, 270, 272, 282, 281, 53, 279; 430/122.1
See application file for complete search history.

(56) References Cited

U.S. PATENT DOCUMENTS 4,131,357 A * 12/1978 Forbes, 2nd ..... 399/269
4,177,757 A * 12/1979 Murakawa et al. ..... 399/269
4,442,790 A * 4/1984 Swapceinski et al. ..... 399/269
4,912,511 A * 3/1990 Murasaki ..... 399/269
4,963,937 A * 10/1990 Diehl ..... 399/269
5,630,201 A * 5/1997 Suzuki et al. ..... 399/269
5,708,940 A * 1/1998 Hosaka et al. ..... 399/266
5,930,569 A * 7/1999 Roof et al. ..... 399/269
6,055,401 A * 4/2000 Tonomoto et al. ..... 399/269
6,733,891 B1 * 5/2004 Blair et al. ..... 399/279
7,231,168 B2 * 6/2007 Hirobe ..... 399/269 X
2004/0258435 A1 12/2004 Hays et al.
2005/0287306 A1 * 12/2005 Hays et al. ..... 427/458
2006/0008300 A1 * 1/2006 Tanaka ..... 399/269
2007/0122208 A1 * 5/2007 Hays ..... 399/272

FOREIGN PATENT DOCUMENTS

JP 04-214581 8/1992
JP 2000-181203 6/2000
JP 2001-290364 10/2001
JP 2003-280284 10/2003

* cited by examiner

*Primary Examiner*—Sophia S Chen
(74) *Attorney, Agent, or Firm*—Roylance, Abrams, Berdo & Goodman, L.L.P.

(57) ABSTRACT

An electrophotographic image forming device is provided which includes an image holder on which an electrostatic latent image is formed. A magnetic roller has a magnetic brush including nonmagnetic toner and a magnetic carrier using a magnetic force. Donor rollers are provided which have toner layers that are received from the magnetic roller on an outer circumference of each of the donor rollers. The donor rollers are located opposite to the image holder to develop the toner onto the electrostatic latent image.

8 Claims, 4 Drawing Sheets

ELECTROPHOTOLITHOGRAPHIC IMAGE FORMING DEVICE AND IMAGE DEVELOPING METHOD

CROSS-REFERENCE TO RELATED PATENT APPLICATIONS

This application claims the benefit under 35 U.S.C. § 119 (a) of Korean Patent Application No. 10-2005-0028073, filed on Apr. 4, 2005, the entire disclosure of which is hereby incorporated by reference.

BACKGROUND OF THE INVENTION

1. Field of the Invention

The present invention relates to an image forming device and an image developing method. More particularly, the present invention relates to an electrophotographic image forming device using magnetic carriers and nonmagnetic carriers and an image developing method using the same.

2. Description of the Related Art

Examples of image development used in an image forming device using electrophotography are copiers, printers, facsimiles, and multi-function devices. These devices include two-component development using toner and magnetic carriers, single-component development using only insulative toner or conductive toner, and hybrid development in which only charged toner is attached onto a developing roller and transferred to an electrostatic latent image. The electrostatic latent image is developed using a two-component developing agent in which nonmagnetic toner and magnetic carriers are mixed.

Due to the use of two-component development, electrification of toner is relatively good, and the image forming device can have a relatively long life span. Additionally, uniform beta images can be formed. However, the two-component development also has disadvantages such as enlargement, complex parts, toner scattering, attachment of carriers to a latent image, and degradation of images due to a reduced durability of carriers.

Due to the use of single component development, the size of a developing device can be minimized, while the quality of dot reproduction may be maintained. However, degradation of the developing and charge rollers performance may affect the durability of the developing device. When the toner is empty, the whole developing device must be replaced, so it can be costly. Furthermore, selective development may occur. Selective development denotes attachment of only a portion of toner which has a predetermined weight and a predetermined amount of charge on a developing roller to an electrostatic latent image. When such selective development continues, residual toner, that is, toner having a weight and charge less than the predetermined values, is not used during development. Therefore, a toner usage rate is reduced.

Due to the use of a hybrid development, dot reproduction is relatively good and the lifespan of the developing device can have be increased. Moreover, fast image formation is possible. Japanese Patent Publication Nos. 6-67546, 7-72733 (U.S. Pat. No. 5,420,375), and 7-92804, the entire disclosures of which are hereby incorporated by reference, disclose hybrid developments each using a magnetic roller and a donor roller. In the hybrid developments, toner is supplied to the donor roller by the magnetic roller. Electrodes are installed between the donor roller and a photosensitive conductor. A bias voltage, in which a direct current (DC) and an alternating current (AC) are mixed, is applied to the space between the electrodes and the donor roller to form a toner cloud around the electrodes to develop an electrostatic latent image on the photosensitive conductor.

In the development system, where the electrodes are installed between the donor roller and the photosensitive conductor, irregular development occurs due to a vibration of electrode wires electrically biased and tensed. Alternatively, stripped traces develop on the donor roller due to the instant attachment of dust to the electrodes. To address this problem, Japanese Patent Publication No. 2000-250294, the entire disclosure of which is hereby incorporated by reference, discloses a development system using a donor roller in which the electrodes are buried. Since the development system needs a brush electrode for supplying a bias voltage having overlapped AC and DC to the buried electrodes, the development system is complicated and expensive. Additionally, when the brush electrode is contaminated or toner is fused to the brush electrode, the contact between the brush electrode and the electrodes of the donor roller is difficult. Furthermore, when consecutive image patterns of high concentration are developed, fine powdered toner and a contaminating material produced from the toner attach to the donor roller, thereby causing a toner film on the donor roller. Thus, a toner layer on the donor roller becomes irregular, and image irregularity, such as generation of spots on an image may relatively easily develop.

In the hybrid development, ghost image development can also occur. Ghost image development comprises a phenomenon in which a previous image remains on a currently developed image. Toner supplied to the donor roller by the magnetic roller is partially developed onto the photosensitive conductor. To perform the next development, the magnetic roller supplies toner to the donor roller to supplement the amount of toner consumed during the previous development. At this time, if the amount of toner supplied to the donor roller by the magnetic roller is insufficient, the consumed toner cannot be effectively supplemented. Then, a toner layer on the donor roller has an uneven thickness, so that ghost image development occurs.

Accordingly, there is a need for an improved electrophotographic image forming device and a developing method which prevents the development of image irregularities such as ghost images generated during consecutive print jobs.

SUMMARY OF THE INVENTION

An aspect of the present invention is to address at least the above problems and/or disadvantages and to provide at least the advantages described below. Accordingly, an aspect of the present invention is to provide a an electrophotographic image forming device and a developing method, by which the development of image irregularities such as ghost images can be prevented and images of high quality can be obtained for an extended period of time.

According to an aspect of the present invention, there is provided an electrophotographic image forming device including an image holder on which an electrostatic latent image is formed. A magnetic roller forms a magnetic brush including nonmagnetic toner and a magnetic carrier using a magnetic force. A plurality of donor rollers receive toner layers from the magnetic roller on an outer circumference of each of the donor rollers. The donor rollers are located opposite to the image holder. The donor rollers develop the toner onto the electrostatic latent image.

A toner consumption rate of each of the donor rollers, when a surface of each of the donor rollers is located at a point closest to the image holder, may be equal to or less than about 70%.

A plurality of the magnetic rollers may be included to supply toner to the plurality of donor rollers.

At least one of the plurality of donor rollers may have a diameter different from diameters of the other donor rollers.

According to another aspect of the present invention, there is provided a hybrid developing method comprising the steps of forming a toner layer on an outer circumference of a donor roller from toner received from a magnetic brush comprised of a magnetic carrier and nonmagnetic toner formed by a magnetic roller, developing an electrostatic latent image on an image holder via a developing bias voltage applied to the donor roller, forming toner layers on a plurality of the donor rollers, and sequentially supplying toners on the plurality of donor rollers to the electrostatic latent image to perform image development.

The method may also comprise the step of controlling apotential of the developing bias voltage and potentials of an image portion and a non-image portion of the electrostatic latent image so that a toner consumption rate of each of the donor rollers is about 70% or less during image development.

The method may further comprise the step of controlling a circumferential speed ratio of the plurality of donor rollers to the image holder so that the toner consumption rate of each of the donor rollers is about 70% or less during image development.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other objects, features, and advantages of certain exemplary embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the exemplary embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
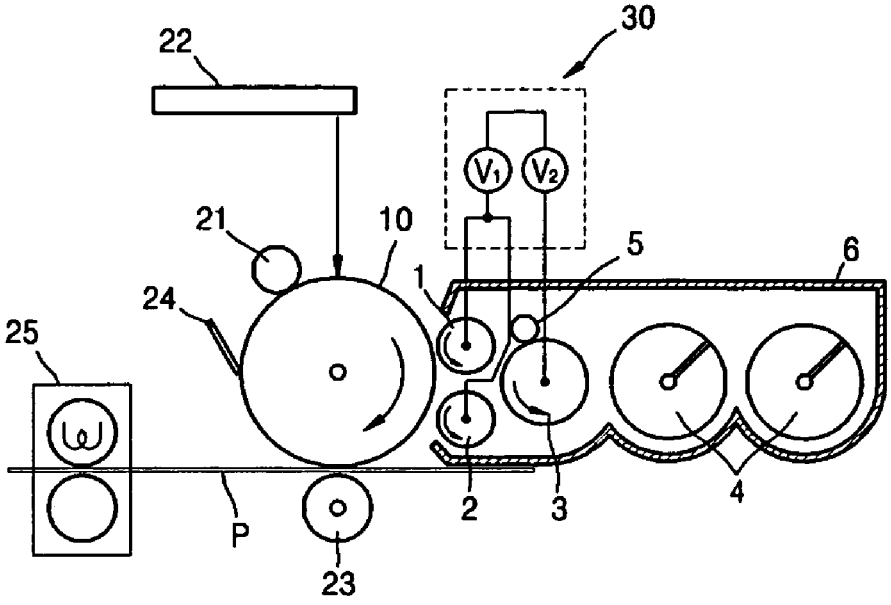
FIG. 1 illustrates a structure of an image forming device according to an exemplary embodiment of the present invention.

An image forming device according to the exemplary embodiments of the present invention uses a plurality of donor rollers. Referring to FIG. 1, an image forming device according to an embodiment of the present invention includes an image holder 10, a first donor roller 1, a second donor roller 2, a magnetic roller 3, and an agitator 4. In this embodiment, an organic photosensitive conductor is used as the image holder 10. An amorphous silicon photosensitive conductor, an electrostatic drum, or any other suitable conductor may be used as the image holder 10. A charger 21 and an exposer 22 are included to form an electrostatic latent image on the image holder 10. A corona discharger or a charge roller may be used as the charger 21. In this case, an electrostatic recording head (not shown) instead of the exposer 22 is used to form the electrostatic latent image. A laser scanning unit (LSU) may also be used as the exposer 22 to radiate light.

Figure 2:
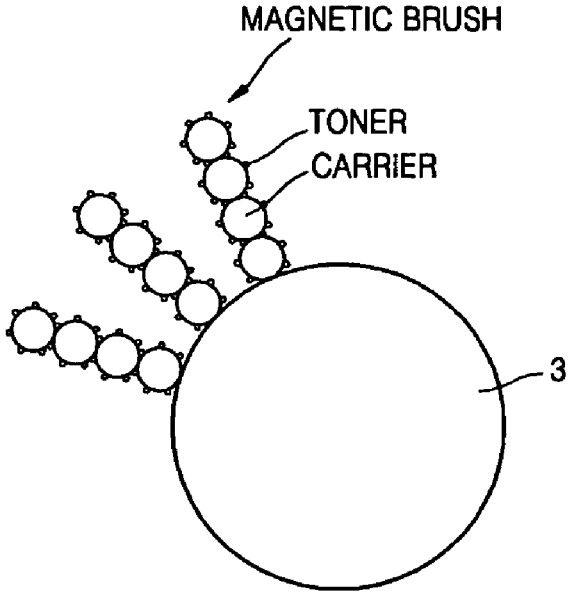
FIG. 2 illustrates magnetic brushes.

A housing 6 contains nonmagnetic toner and magnetic carriers. The magnetic carriers may be of any suitable type comprising magnetic powder. The agitator 4 agitates the magnetic carriers and the nonmagnetic toner to rub the toner with each other and charge the toner. The nonmagnetic toner may be either negatively or positively charged. The carriers are attached to an outer circumference of the magnetic roller 3 by a magnetic force of the magnetic roller 3, and the charged toner is attached to the carriers by static electricity. Then, as shown in FIG. 2, magnetic brushes each including carriers and toner are formed on the outer circumference of the magnetic roller 3. A trimmer 5 controls the magnetic brushes so that they can have predetermined thicknesses. An interval between the trimmer 5 and the magnetic roller 3 may be about 0.3 to 1.5 mm.

The first and second donor rollers 1 and 2 are located between the image holder 10 and the magnetic roller 3. The number of donor rollers is not limited to two but may be three or more if necessary. Alternatively, the number of magnetic rollers 3 is not limited to one but may be two or more. A gap between each of the first and second donor rollers 1 and 2 and the image holder 10, that is, a developing gap, may be about 150 to 400 μm, and preferably about 200 to 300 μm. When the developing gap is smaller than about 150 μm, the image may fade. When the developing gap is greater than about 400 μm, transferring the toner onto the image holder 10 is relatively difficult, so that a sufficient image concentration is difficult to obtain. This causes selective developing. The interval between the magnetic roller 3 and each of the first and second donor rollers 1 and 2 may be about 0.2 to 1.0 mm, preferably, about 0.3 to 0.4 mm. Each of the first and second donor rollers 1 and 2 may be either a sleeve formed of conductive aluminum or stainless steel having a volume resistivity of $10^6 \Omega \cdot cm^3$ or less, or a sleeve coated with conductive resin having about the above volume resistivity. The first and second donor rollers 1 and 2 are preferably formed of an identical material, but may be formed of different materials. Diameters of the first and second donor rollers 1 and 2 may be identical or different. Using a plurality of donor rollers having different diameters may be advantageous to improve manufacturer flexibility when arranging the image holder 10, the donor rollers 1 and 2, and the magnetic roll 3 with respect to one another.

A bias applying unit 30 applies a developing bias voltage $V_1$ to the first and second donor rollers 1 and 2 and a supply bias voltage $V_2$ to the magnetic roller 3. The supply bias voltage $V_2$ is used to provide an electric field between the magnetic roller 3 and the first and second donor rollers 1 and 2 which is effective in transferring toner on the magnetic roller 3 to the first and second donor rollers 1 and 2. A direct current (DC) bias voltage or a bias voltage in which a DC bias voltage and an alternating current (AC) bias voltage overlap may be used as the supply bias voltage $V_2$. A toner layer is formed on an outer circumference of the first donor roller 1 by the supply bias voltage $V_2$. The developing bias voltage $V_1$ is used to separate toner from the toner layer formed on the outer circumferences of the donor rollers 1 and 2 and moves the toner onto an electrostatic latent image on the image holder 10 via the developing gap. To achieve this, a bias voltage in which a DC bias voltage and an AC bias voltage overlap is used as the developing bias voltage $V_1$.

In this structure, the charger 21 charges a surface of the image holder 10, which is a photosensitive conductor, to a uniform potential. The exposer 22 projects light corresponding to image information onto the image holder 10. As a result, an electrostatic latent image comprises an image portion and a non-image portion having different potentials which are formed on the surface of the image holder 10. Toner separates from magnetic brushes on the magnetic roller 3 by the supply bias voltage $V_2$ applied thereto and is transferred to the first and second donor rollers 1 and 2. Uniform toner layers are formed on the outer circumferences of the first and second donor rollers 1 and 2. When the toner layers formed on the first and second donor rollers 1 and 2 face the image portion of the electrostatic latent image while passing the developing gap, toner separates from the toner layers on the first and second donor rollers 1 and 2 by the developing bias voltage $V_1$. The toner then attaches to the image portion to develop the electrostatic latent image into a toner image. The toner image is transferred onto a recording medium P by transporting electric field via a transferor 23. A fuser 25 fuses the toner image on the recording medium P using heat and pressure, and a cleaning blade 24 removes residual toner from the surface of the image holder 10.

Figure 3:
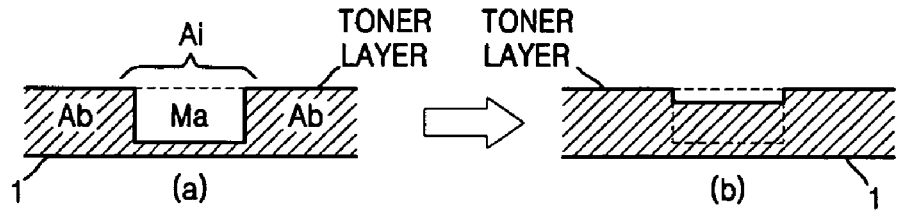
FIG. 3 illustrates a process in which a ghost is generated during a conventional developing operation.

Since the image forming device according to the present embodiment uses a plurality of donor rollers, namely, the first and second donor rollers 1 and 2, the device reduces the amount of toner consumed by the first and second donor rollers 1 and 2 to obtain a predetermined image concentration. Therefore, a sufficient amount of toner can be supplied from the magnetic roller 3 to each of the first and second donor rollers 1 and 2. This will now be described with reference to FIGS. 3 and 4. FIG. 3 illustrates an image forming device employing a single toner roller 1, and FIG. 4 illustrates an image forming device employing two toner rollers 1 and 2.

Referring to FIG. 3(*a*), an area Ai of a toner layer formed on the toner layer 1 that faces the image portion on the image holder 10 is attached to the image holder 10 by a developing bias voltage. However, an area Ab of the toner layer that faces the non-image portion on the image holder 10 is not developed and remains on the surface of the donor roller 1. The amount of toner separated from the area Ai and attached to the image holder 10 is indicated by Ma. To continue such developing, the magnetic roller 3 supplies toner to the area Ai. When the amount of toner supplied from the magnetic roller 3 to the donor roller 1 is less than Ma, the toner layer formed on the surface of the donor roller 1 has an uneven thickness as shown in FIG. 3(*b*), so that development of a ghost image occurs, for example, an afterimage of a currently developed image appears during a next development.

Figure 4:
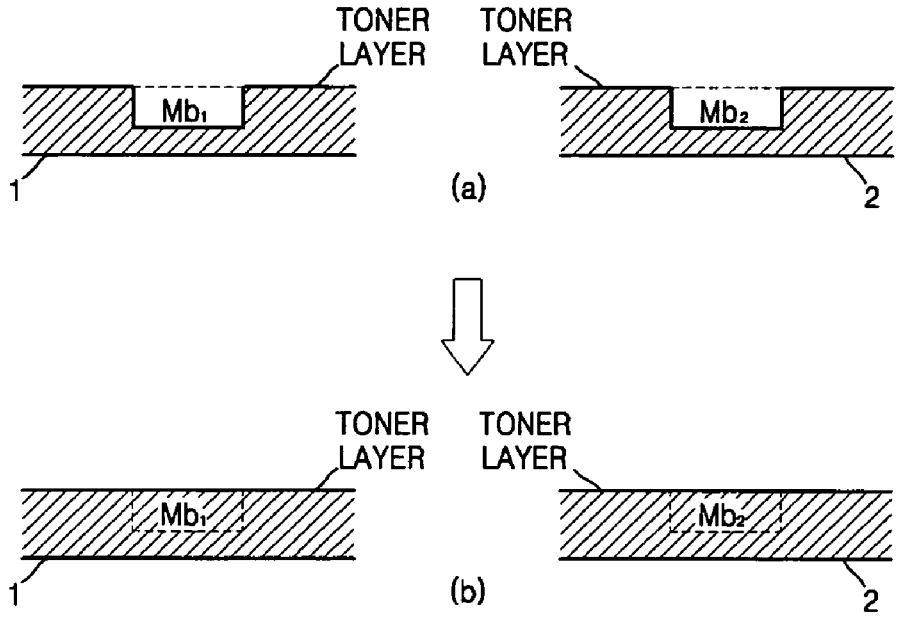
FIG. 4 illustrates a developing operation of the image forming device of FIG. 1.

Referring to FIG. 4(*a*), the image holder 10 sequentially faces the first and second donor rollers 1 and 2. Toner on the first and second donor rollers 1 and 2 is attached to the image portion on the image holder 10. The amounts of toner on the first and second donor rollers 1 and 2 attached to the image holder 10 are referred to as Mb1 and Mb2, respectively, which are the amounts of toner to be supplied from the magnetic roller 3 to the first and second tone rollers 1 and 2. If toner images developed on the image holder 10 in the cases of FIGS. 3 and 4 have identical concentrations, Ma is equal to Mb1+Mb2. Accordingly, Ma is greater than Mb1 and also greater than Mb2. Although the overall amount of toner to be supplied from the magnetic roller 3 to the first and second donor rollers 1 and 2 is Ma, the magnetic roller 3 supplies a half of the overall amount of toner, namely, Mb1, to the first donor roller 1 and the other half, namely, Mb2, to the second donor roller 2. Thus, although the amount of toner that can be supplied by the magnetic roller 3 at a time is less than Ma, the amount of toner is supplied twice, so a sufficient amount of toner is supplied to the first and second donor rollers 1 and 2 to form uniform toner layers as shown in FIG. 4(*b*). Thus, development of ghost images due to lack of the amount of toner supplied by the magnetic roller 3 can be prevented. As described above, in cases where a plurality of donor rollers, namely, the first and second donor rollers 1 and 2, are used, toner layers of even thicknesses can be formed on the donor rollers 1 and 2 not only when images are developed occasionally, but also when images are developed consecutively. Consequently, development of ghost images can be prevented. In particular, the use of a plurality of donor rollers is very effective in preventing occurrence of the development of ghost images when images of high concentrations are consecutively developed. The use of a plurality of donor rollers enables stable images of good quality to be formed. In addition, an electrostatic latent image is developed with toner several times, so that an image with a sufficient concentration can be obtained.

A percentage such as a toner consumption rate of toner on the first and second donor rollers 1 and 2, which is occupied by toner detached from the first and second donor rollers 1 and 2 when the toner, is located at a point the closest to the image holder 10, that is, passes the developing gap, is useful in more effectively preventing development of ghost images. This will now be described. The toner consumption rate is calculated as follows: [(amount of toner on the toner roller before development—amount of toner on toner roller after development)/amount of toner on toner roller before development)×100%]. The amount of toner may be represented as an optical density. An optical density is a numerical value of the detected amount of light reflected from the irradiated surfaces of the donor rollers 1 and 2. Since the detected amount of reflected light varies according to the amount of toner, the amount of toner can be ascertained from the amount of reflected light. If the toner consumption rate is rewritten as an optical density, the toner consumption rate is determined by calculating: [toner consumption rate=100×(1−O.D.1/O.D.2) (unit: %)], wherein O.D.1 denotes an optical density of a donor roller after development, and O.D.2 denotes an optical density of a donor roller before development. Experimental data illustrates that relatively good image concentration was obtained when the toner consumption rate was equal to or less than 70%. In addition, the development of a ghost image was effectively prevented even during consecutive developments. When a portion of the toner layer formed on each of the first and second donor rollers 1 and 2 faces a non-image portion of an electrostatic latent image on the image holder 10 when passing the developing gap, a toner consumption rate of the portion is nearly 0%. Accordingly, when the toner consumption rate is equal to or less than 70%, this only corresponds to portions of the toner layer that face an image portion of the electrostatic latent image on the image holder 10 when passing the developing gap.

Figure 5:
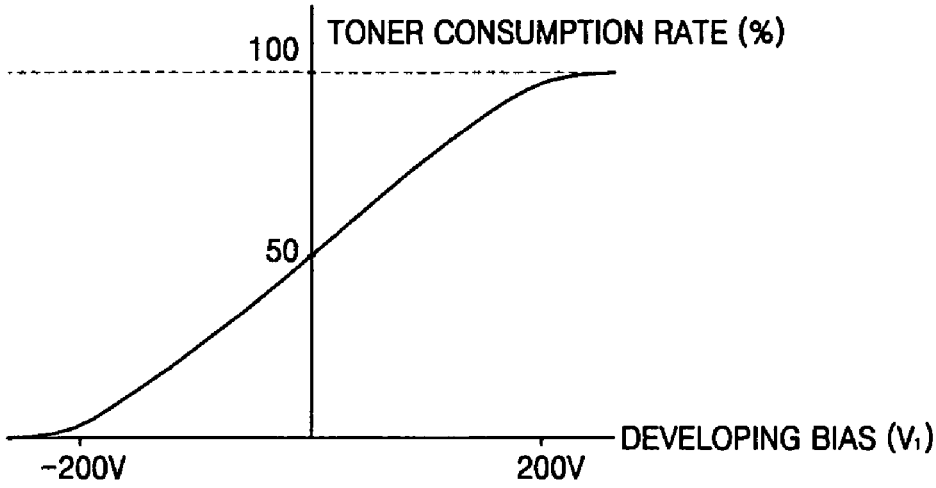
FIG. 5 is a graph showing a relationship between a developing bias voltage and a toner consumption rate.
Figure 6:
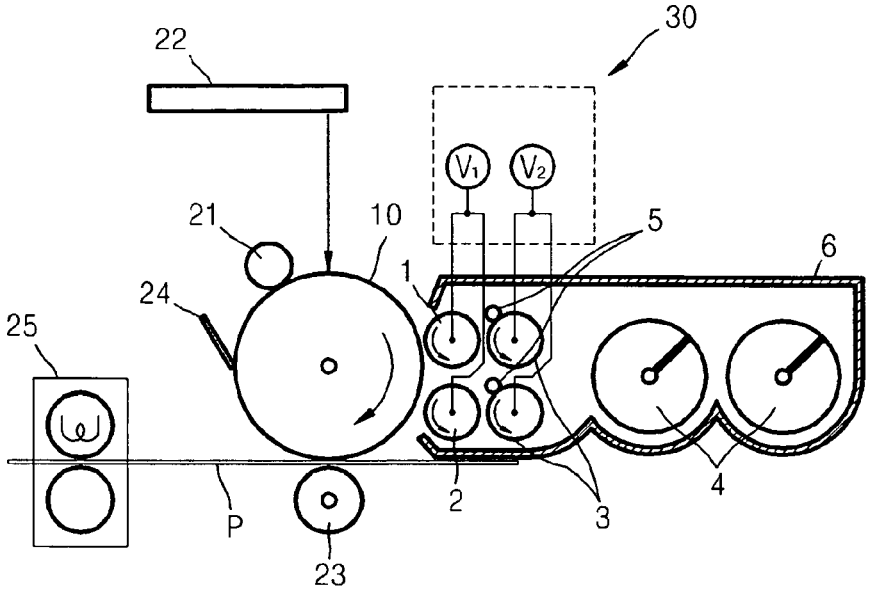
FIG. 6 illustrates an embodiment having a plurality of magnetic rollers.
Figure 7:
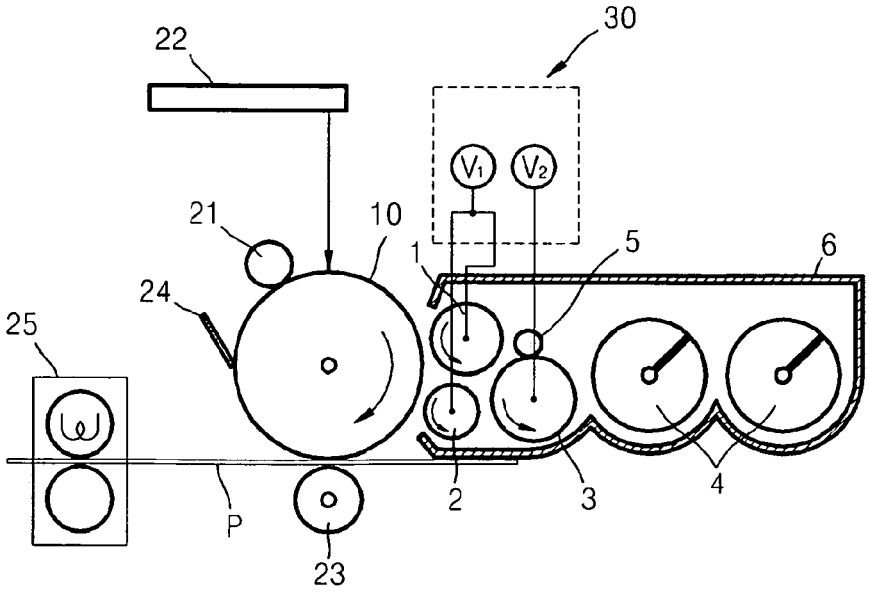
FIG. 7 illustrates an embodiment in which at least one of the plurality of donor rollers has a diameter different from the other donor rollers.

The toner consumption rate has a relation with an electric field acting between the image holder 10 and the first and second donor rollers 1 and 2. The electric field is produced by the potentials of the image and the non-image portions and the potential of the developing bias voltage $V_1$. For reference, FIG. 5 is a graph showing a relationship between the developing bias voltage $V_1$ and a toner consumption rate. The toner consumption rate can be controlled to be about 70% or less by adequately adjusting the potentials of the image portion and the non-image portion and the potential of the developing bias voltage $V_1$. Since the potentials of the image and the non-image portions, and the potential of the developing bias voltage $V_1$ may vary according to developing conditions, an interval between the first and second donor rollers 1 and 2 and the numerical values shown in FIG. 5 are interchangeable.

The toner consumption rate may be controlled according to a ratio of circumferential speeds of the first and second donor rollers 1 and 2 to a circumferential speed of the image holder 10. As the ratio increases, that is, as circumferential speeds of the first and second donor rollers 1 and 2 increase, the toner consumption rate decreases. As the ratio decreases, the toner consumption rate increases.

In an experiment, an organic photosensitive conductor was used as the image holder 10, the interval (developing gap) between the first and second donor rollers 1 and 2 and the image holder 10 was set to about 250 μm, and electrode wires used in conventional image forming devices were not installed between the first and second donor rollers 1 and 2 and the image holder 10. A charge potential of the image holder 10, for example the potential of a non-image portion, was set to about −600V, and a potential of an exposed portion, for example a potential of an image portion, was set to about −50V. A bias voltage produced by the overlapping of a DC of about −300V and an AC voltage having an amplitude of about 300V and a frequency of 1 kHz was applied as the developing bias voltage $V_1$ to the first and second donor rollers 1 and 2. A DC bias of −500V was applied as the supply bias voltage $V_2$ to the magnetic roller 3. In this experiment, a toner consumption rate of each of the first and second donor rollers 1 and 2 was about 50%. Additionally, a measurement of optical densities proved that thicknesses of the toner layers formed of toner consecutively received from the magnetic roller 3 on the first and second donor rollers 1 and 2 were uniform. An image developed under the above-described conditions had a sufficient concentration, and a good quality. Therefore, stable images without ghost images were obtained even upon consecutive developments.

A comparative experiment having conditions similar to the previous experiment was made to an image forming device including only the first donor roller 1 instead of the first and second donor rollers 2. To obtain an image concentration almost the same as the image concentration obtained in the previous experiment, a potential of a DC component of a developing bias voltage applied to the first donor roller 1 was set to about −500V, and a potential of a supply bias voltage applied to the magnetic roller 3 was set to about −700V. In this experiment, a toner consumption rate of the first donor roller 1 was about 90%. Additionally, a measurement of optical densities proved that a thickness of the toner layer formed of toner consecutively received from the magnetic roller 3 on the first donor roller 1 was not uniform. An image developed under these conditions had a sufficient concentration, but ghost images occurred upon consecutive developments.

Although a mono-chromatic image forming device and a developing method therefor have been described above, a structure of the image forming device and the developing method may be applied to single-pass color image forming devices having tandem structures and multi-pass color image forming devices which develop a single image holder several times and sequentially transports results of the several developments to an intermediate transport member.

As described above, an image forming device according to the exemplary embodiments of the present invention use a plurality of donor rollers, thus reducing a toner consumption rate of each of the donor rollers. Thus, toner layers of even thicknesses can be formed on the donor rollers by a magnetic roller, so that development of a ghost image can be prevented. Furthermore, a high-quality, stable image without ghost images can be obtained even upon consecutive printing by setting the toner consumption rate to 70% or less.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An electrophotographic image forming device, comprising:

an image holder on which an electrostatic latent image is formed;

a magnetic roller forming a magnetic brush including non-magnetic toner and a magnetic carrier using a magnetic force;

a plurality of donor rollers, including a toner layer formed of toner received from the magnetic brush of the magnetic roller on an outer circumference of each of the donor rollers, located opposite to the image holder;

a bias applying unit applying a developing bias voltage to develop the toner from the plurality of donor rollers directly onto the electrostatic latent image via a developing gap; and a charger used to form the electrostatic latent image on the image holder;

wherein the charger and the bias applying unit control the potential of the developing bias voltage and potentials of an image portion and a non-image portion of the electrostatic latent image so that a toner consumption rate of each of the donor rollers is about 70% or less during image development.

2. The electrophotographic image forming device of claim 1, wherein a plurality of the magnetic rollers are included to supply toner to the plurality of donor rollers.

3. The electrophotographic image forming device of claim 1, wherein at least one of the plurality of donor rollers has a diameter different from a diameter of the remainder of the plurality of donor rollers.

4. The electrophotographic image forming device of claim 1, wherein:

a plurality of the magnetic rollers are included to supply toner to the plurality of donor rollers; and a toner consumption rate of each of the donor rollers when a surface of each of the donor rollers is located at a point closest to the image holder is equal to or less than about 70%.

5. The electrophotographic image forming device of claim 4, wherein at least one of the plurality of donor rollers has a diameter different from a diameter of the remainder of the plurality of donor rollers.

6. A hybrid developing method comprising the steps of:

forming a toner layer on an outer circumference of each of a plurality of donor rollers from toner received from a magnetic brush comprised of a magnetic carrier and nonmagnetic toner formed by a magnetic roller;

supplying toners on the plurality of donor rollers to an electrostatic latent image on an image holder to perform image development via a developing bias voltage applied to the plurality of donor rollers; and controlling a potential of the developing bias voltage and potentials of an image portion and a non-image portion of the electrostatic latent image so that a toner consumption rate of each of the donor rollers is about 70% or less during image development.

7. A hybrid developing method comprising the steps of:

forming a toner layer on an outer circumference of each of a plurality of donor rollers from toner received from a magnetic brush comprised of a magnetic carrier and nonmagnetic toner formed by a magnetic roller;

supplying toners on the plurality of donor rollers directly to an electrostatic latent image on an image holder via a developing gap to perform image development via a developing bias voltage applied to the plurality of donor rollers; and controlling a circumferential speed ratio of the plurality of donor rollers to the image holder so that the toner consumption rate of each of the donor rollers is about 70% or less during image development.

8. An image forming device, comprising:

an image holder on which a latent image is formed;

a plurality of magnetic rollers forming a magnetic brush including nonmagnetic toner and a magnetic carrier using a magnetic force;

a plurality of donor rollers, including a toner layer formed of toner received from the magnetic brush of the magnetic rollers on an outer circumference of each of the donor rollers, located opposite to the image holder;

a bias applying unit applying a developing bias voltage to develop the toner from the plurality of donor rollers directly onto the latent image via a developing gap, wherein at least one of the plurality of donor rollers has a diameter different from a diameter of the remainder of the plurality of donor rollers; and a charger used to form the latent image on the image holder;

wherein the charger and the bias applying unit control the potential of the developing bias voltage and potentials of an image portion and a non-image portion of the latent image so that a toner consumption rate of each of the donor rollers is about 70% or less during image development.

* * * * *